US005701059A

United States Patent [19]

Steigerwald et al.

[11] Patent Number: 5,701,059

[45] Date of Patent: Dec. 23, 1997

[54] ELIMINATION OF STRIATIONS IN FLUORESCENT LAMPS DRIVEN BY HIGH-FREQUENCY BALLASTS

[75] Inventors: Robert Louis Steigerwald, Burnt Hills; Ljubisa Dragoljub Stevanovic, Clifton Park, both of N.Y.

[73] Assignee: General Electric Company, Schenectady, N.Y.

[21] Appl. No.: 578,795

[22] Filed: Dec. 26, 1995

[51] Int. Cl.[6] ..... H05B 41/14

[52] U.S. Cl. ..... 315/219; 315/166; 315/224; 315/DIG. 5

[58] Field of Search ..... 315/176, 171, 315/166, 219, DIG. 4, DIG. 5, 224

[56] References Cited

U.S. PATENT DOCUMENTS

| | | | |
|---|---|---|---|
| 4,682,082 | 7/1987 | MacAskill et al. | 315/219 |
| 5,001,386 | 3/1991 | Sullivan et al. | 315/219 |
| 5,192,896 | 3/1993 | Qin | 315/224 |
| 5,369,339 | 11/1994 | Reijnaerts | 315/209 R |

FOREIGN PATENT DOCUMENTS 0547674 6/1993 European Pat. Off. .

OTHER PUBLICATIONS

"Development of an Electronic Dimming Ballast for Fluorescent Lamps", A. Okude, A. Ueoka, Y. Kambara, M. Mitani., Journal of the Illuminating Engineering Society, Winter, 1992.

*Primary Examiner*—Robert Pascal
*Assistant Examiner*—David Vu
*Attorney, Agent, or Firm*—Jill M. Breedlove; Marvin Snyder

[57] ABSTRACT

A ballast system for at least one dimmable fluorescent lamp includes a ballast inverter for driving the fluorescent lamp to provide light output and a parallel impedance for coupling across the fluorescent lamp for providing an alternative path for diverting sufficient ac current to avoid developing striated light output as the light output is dimmed. The parallel impedance may be a resistor connected in series with a diode. For multiple lamp systems, the parallel impedance may be connected across one or more of the lamps.

11 Claims, 4 Drawing Sheets

ELIMINATION OF STRIATIONS IN FLUORESCENT LAMPS DRIVEN BY HIGH-FREQUENCY BALLASTS

FIELD OF THE INVENTION

The present invention relates generally to fluorescent lamps and, more particularly, to dimmable fluorescent lamps driven by high-frequency electronic ballasts.

BACKGROUND OF THE INVENTION

A problem with dimmable fluorescent lamps is that for low light outputs (e.g., below about 20% full output), the high-frequency discharge current applied by electronic ballasts sometimes causes a standing wave of varying charge densities called striations. Striations are manifested as alternating bands of dim and bright light output along the length of the lamp. One way to avoid striations is to inject a small dc current into the lamp, e.g., on the order of 1 mA. For example, in "Development of an Electronic Dimming Ballast for Fluorescent Lamps", *Journal of the Illuminating Engineering Society*, Winter 1992, A. Okude et al. describe injecting such a small dc current into the lamp using a power supply connected in series with an inductor and a diode, the series circuit being coupled across the lamp. Although this circuitry does eliminate striations, it disadvantageously requires the additional power supply and inductor.

Another way to avoid striations, as described in U.S. Pat. No. 5,001,386 of Sullivan et al., issued Mar. 19, 1991, is to employ a circuit which creates an asymmetrical lamp current waveform having positive and negative portions which are identical in shape, but which is offset from the zero current level. To this end, Sullivan et al. use a back end rectifier circuit including a capacitor, a pair of resistors, and a diode. The capacitor is connected between and in series with two secondary windings of the output transformer and in series with the lamp(s). One resistor is connected in series with the diode to charge the capacitor to a dc voltage. This dc voltage causes a dc current to flow through the lamp(s) and two secondary windings of the output transformer. If the capacitance is large enough, the capacitor will pass unattenuated high-frequency sinusoidal current to the lamp(s). The other resistor is connected across the capacitor for discharging the capacitor when power is removed.

Although the circuits described hereinabove avoid striations in the output of a dimmable fluorescent lamp at low output levels, it is desirable to provide circuitry to accomplish this result in a more simple manner with fewer components and no additional power supply.

SUMMARY OF THE INVENTION

A ballast system for at least one dimmable fluorescent lamp comprises a ballast inverter for driving the fluorescent lamp to provide light output and a parallel impedance for coupling across the fluorescent lamp for providing a path for diverting sufficient ac current to avoid developing striated light output as the lamp is dimmed. In a preferred embodiment, the parallel impedance comprises a resistor connected in series with a diode. Alternatively, the parallel impedance may comprise an inductor connected in series with a diode.

In an exemplary fluorescent lamp system comprising two (or more) lamps, a ballast system according to the present invention may comprise a parallel impedance as described hereinabove coupled across either one or both of the lamps. Moreover, if a parallel impedance is coupled across each lamp, then the diodes may be connected in circuit to conduct current in either the same or opposite directions.

BRIEF DESCRIPTION OF THE DRAWINGS

The features and advantages of the present invention will become apparent from the following detailed description of the invention when read with the accompanying drawings in which.

DETAILED DESCRIPTION OF THE INVENTION

Figure 1:
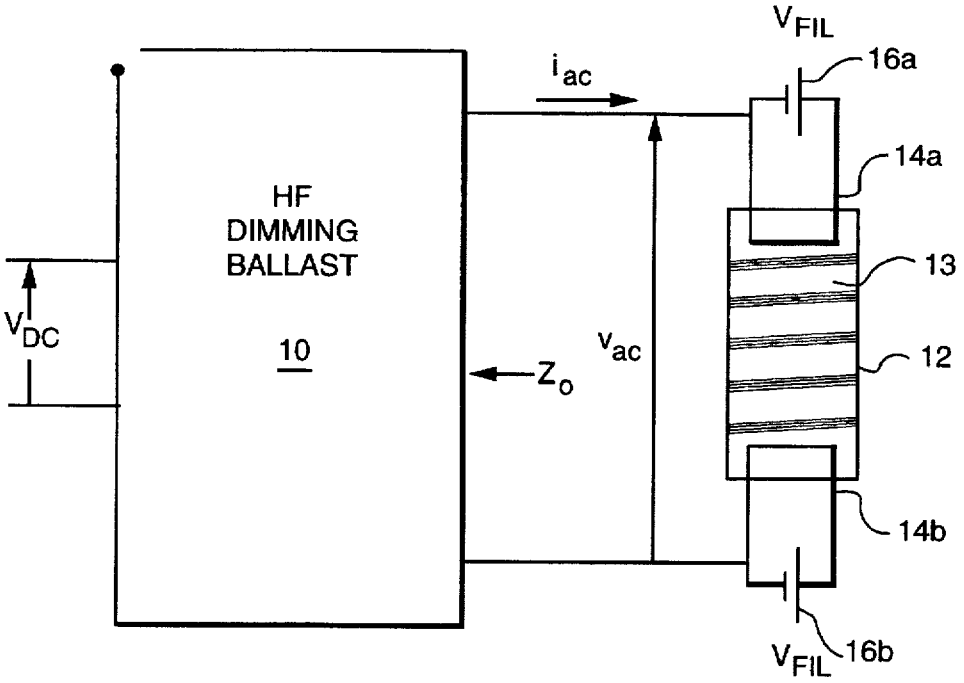
FIG. 1 PRIOR ART
FIG. 1 schematically illustrates an exemplary dimmable fluorescent lamp system.

FIG. 1 illustrates a dimmable fluorescent lamp system including a high-frequency electronic dimming ballast 10 and a lamp 12 having two filaments 14*a* and 14*b*. Each filament has a voltage source 16*a* and 16*b*, respectively, coupled thereacross for sustaining the filament voltage $V_{FIL}$ during lamp operation. High-frequency dimming ballast 10 has a high output impedance $$Z_{out} = \frac{v_{ac}}{i_{ac}}$$

and acts as a current source feeding current $i_{ac}$ to the lamp 12. The high-frequency dimming ballast could be any well-known ballast circuit capable of operating the lamp in a range from 100% to about 1% full light output. The lamp of FIG. 1 is illustrated as having striations 13 that are developed at low output light levels (e.g., below about 20% full output).

Figure 2:
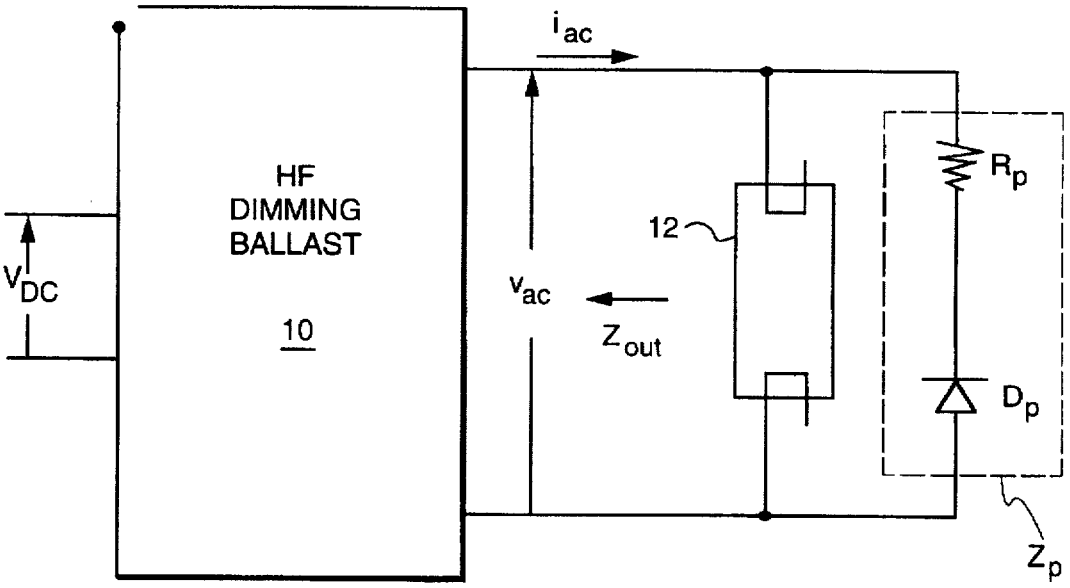
FIG. 2 schematically illustrates a dimmable fluorescent lamp system according to one embodiment of the present invention.

FIG. 2 illustrates a dimmable fluorescent lamp system according to the present invention. A parallel impedance $Z_P$ is connected across the lamp 12 to provide a path for diverting a small current during one-half of each high-frequency cycle, thereby causing a small dc current to be in the lamp. The dc current prevents the development of striations as the light output is dimmed. The parallel impedance is illustrated in FIG. 2 as comprising a diode $D_P$ connected in series with a resistor $R_P$. Alternative embodiments of the parallel impedance $Z_P$ are possible, such as, for example, an inductor in series with a diode.

In operation, during the positive half-cycle of the ac current $i_{ac}$ from the ballast, the current $i_{ac}$ flows only through the lamp due to the orientation of the diode in the illustrated circuit of FIG. 2. However, during the negative half-cycle of the current $i_{ac}$, a portion of the current is diverted through the parallel impedance $Z_P$. As a result, a small dc current is present in the lamp and hence striations are avoided. If, as an alternative embodiment, the diode were oriented in the opposite way with its cathode connected to ground, then operation would be similar except that the negative half-cycle of the current $i_{ac}$ would flow through the lamp with current being diverted through the parallel impedance $Z_P$ during the positive half-cycle. In either case, striations are avoided.

Figure 3:
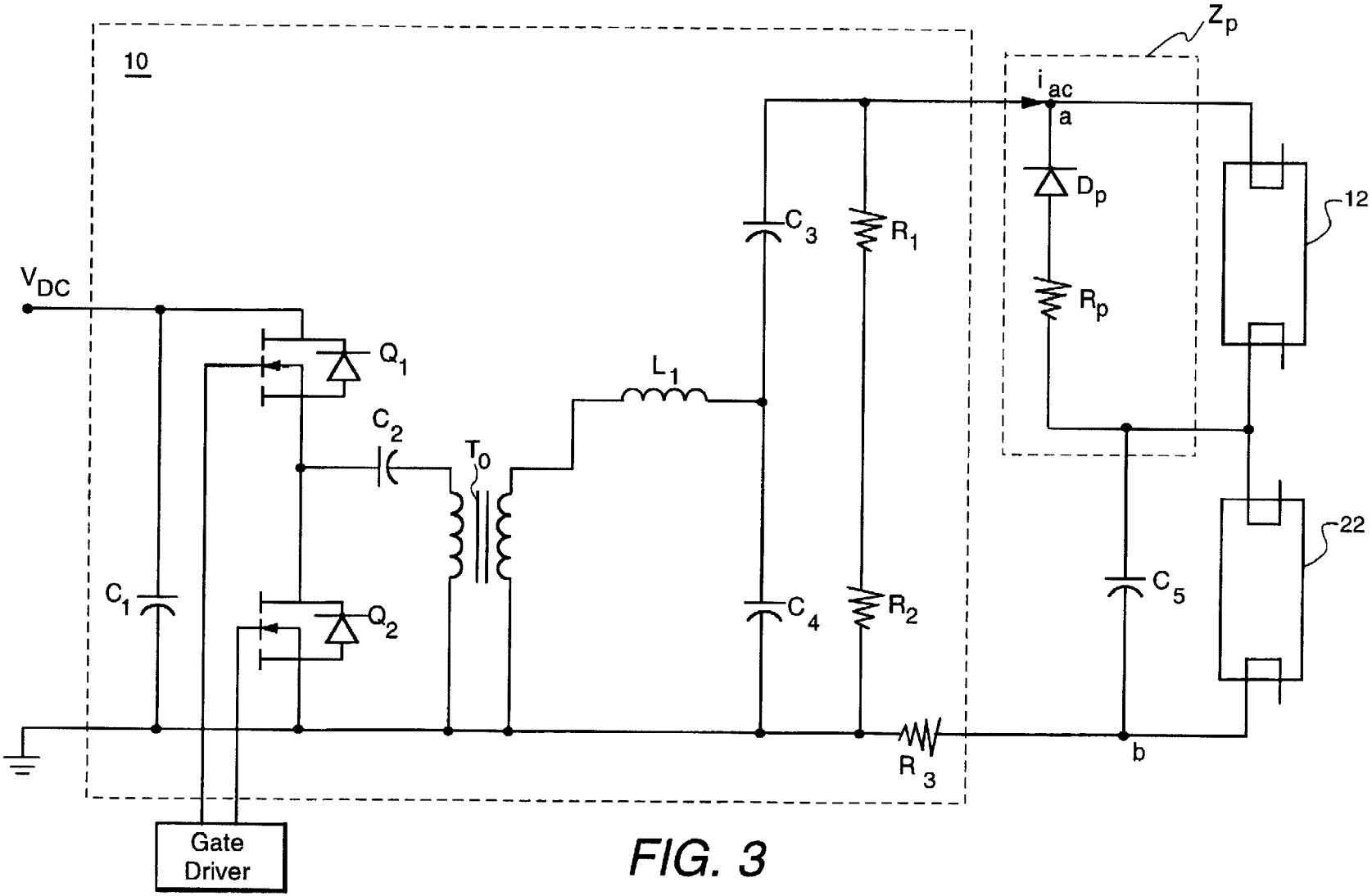
FIG. 3 schematically illustrates a dimmable fluorescent lamp system according to an alternative embodiment of the present invention.

FIG. 3 illustrates a dimmable fluorescent lamp system according to the present invention including a more detailed schematic representation of the ballast 10. Furthermore, FIG. 3 illustrates a two-lamp system with fluorescent lamps 12 and 22. It is to be understood, however, that the present invention applies to fluorescent lamp systems having one or more lamps. The ballast inverter 10 is shown schematically as comprising a conventional half-bridge ballast configuration for a fluorescent lamp. A capacitor C1, typically electrolytic, is coupled across the ballast input in order to provide a rectified, filtered dc voltage to a half-bridge connection of switching devices Q1 and Q2. This input is typically obtained from rectifying an ac utility voltage. Alternatively, it can be obtained directly from a dc source such as a battery. A gate driver circuit (not shown) alternately switches devices Q1 and Q2 to provide bi-directional current flow through a resonant load circuit, including an inductor L1 and a capacitor C4, which is shown as being coupled through an output transformer To and a capacitor C2 to the junction between the switching devices Q1 and Q2. The series-connected lamps 12 and 22 are connected in parallel across series-connected capacitors C3 and C4. The capacitor C3 is used to extend the dimming range of the ballast by changing resonant characteristics of the resonant circuit after the lamp starts. A resistor R3 is provided as a current sensor for controlling the lamp dimming function in a manner well-known in the art. A starting capacitor C5 is connected between the junction joining the lamps and ground, which momentarily shorts the lamp 22 during starting so that a higher voltage is applied to the lamp 12 for starting.

In the embodiment of FIG. 3, the parallel impedance $Z_P$ is connected across only one of the lamps. Although the parallel impedance $Z_P$ is shown as being connected across the upper lamp 12, it could alternatively be connected across the lower lamp 22. In either case, in accordance with the present invention, it is sufficient to couple a parallel impedance across only one of the lamps in a multiple lamp system to avoid striations.

Figure 4:
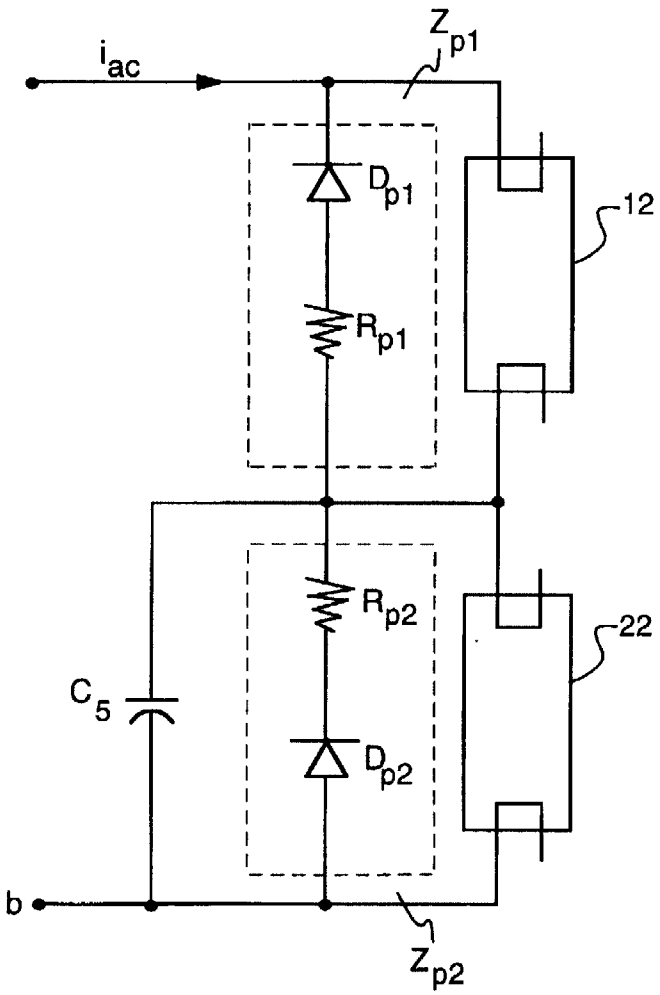
FIG. 4 schematically illustrates a dimmable fluorescent lamp system according to another alternative embodiment of the present invention.

FIGS. 4–7 illustrate alternative embodiments of the dimmable fluorescent lamp system of the present invention as viewed from terminals a and b of FIG. 3. FIG. 4 shows parallel impedances $Z_{P1}$ and $Z_{P2}$, respectively, connected across each lamp 12 and 22, respectively. Specifically, each parallel impedance in FIG. 4 is shown as comprising a diode $D_{P1}$ and $D_{P2}$, respectively, connected in series with a resistor $R_{P1}$ and $R_{P2}$, respectively, with the diodes $D_{P1}$ and $D_{P2}$ oriented to conduct current in the same direction.

Figure 5:
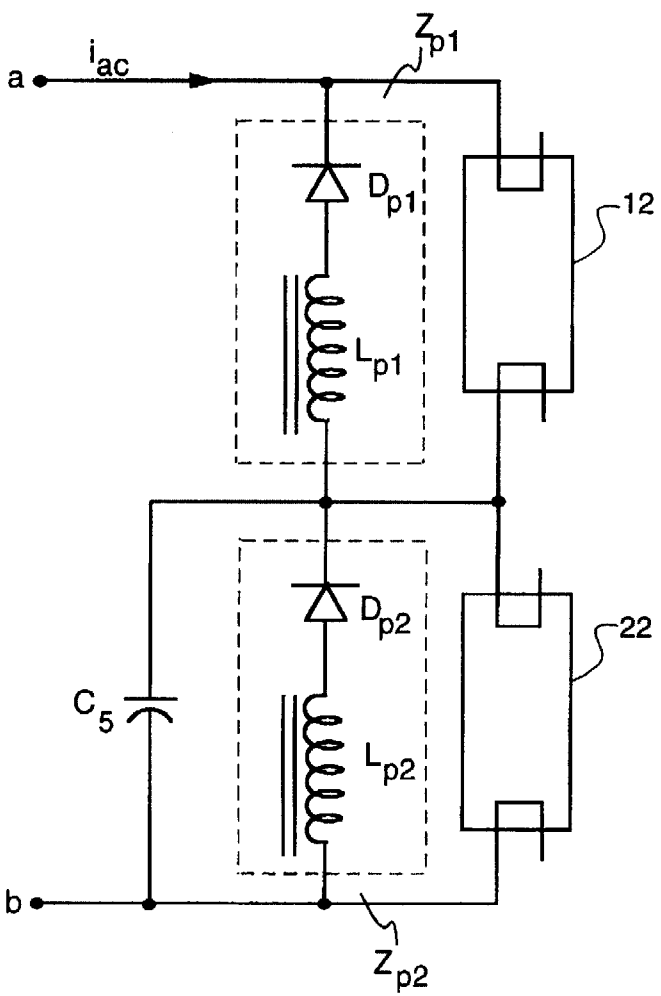
FIG. 5 schematically illustrates a dimmable fluorescent lamp system according to another alternative embodiment of the present invention.

FIG. 5 is an alternative embodiment of FIG. 4 with inductors $L_{P1}$ and $L_{P2}$, respectively, substituted for the resistors $R_{P1}$ and $R_{P2}$, respectively.

Figure 6:
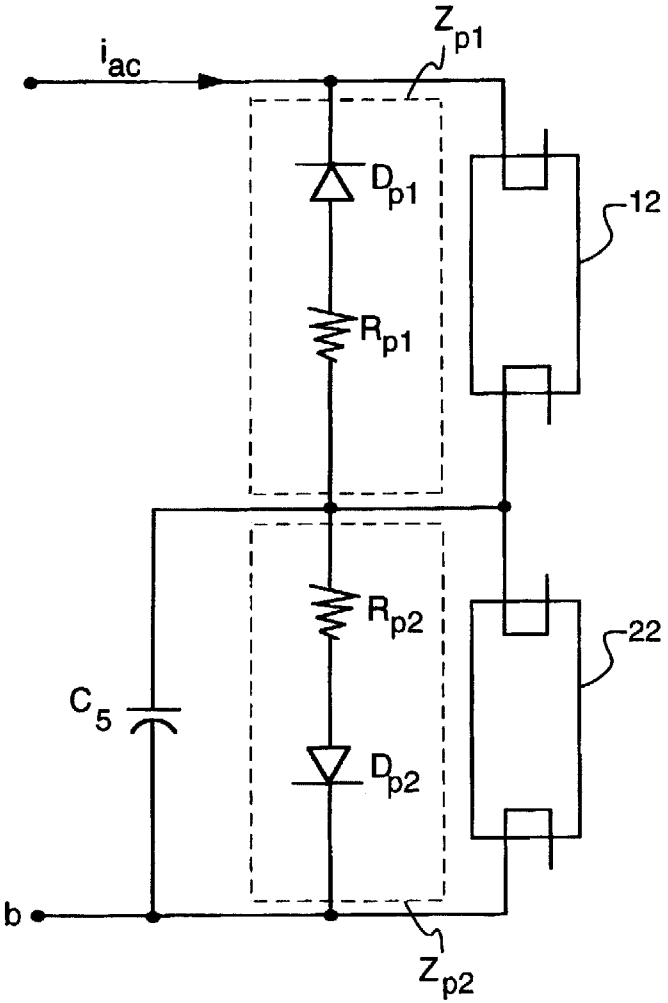
FIG. 6 schematically illustrates a dimmable fluorescent lamp system according to another alternative embodiment of the present invention.

FIG. 6 illustrates another alternative embodiment with a parallel impedance $Z_P$ connected across each lamp 12 and 22, but with the diodes $D_{P1}$ and $D_{P2}$, respectively, oriented to conduct current in opposite directions. During normal operation of the dimmable fluorescent lamp system, the current $i_{ac}$ flows through the series connection of lamps 12 and 22, while only a small portion of the current iac flows through the starting capacitor C5. Also, during the positive half-cycle of the current $i_{ac}$, a small portion of the total current $i_{ac}$ will flow through the impedance $Z_{P2}$ connected in parallel to the lamp 22. During the negative half-cycle of the current $i_{ac}$, a small portion of the total current will flow through the impedance $Z_{P1}$ connected in parallel to the lamp 12. Therefore, both lamps will have a small dc current and striations are avoided.

Figure 7:
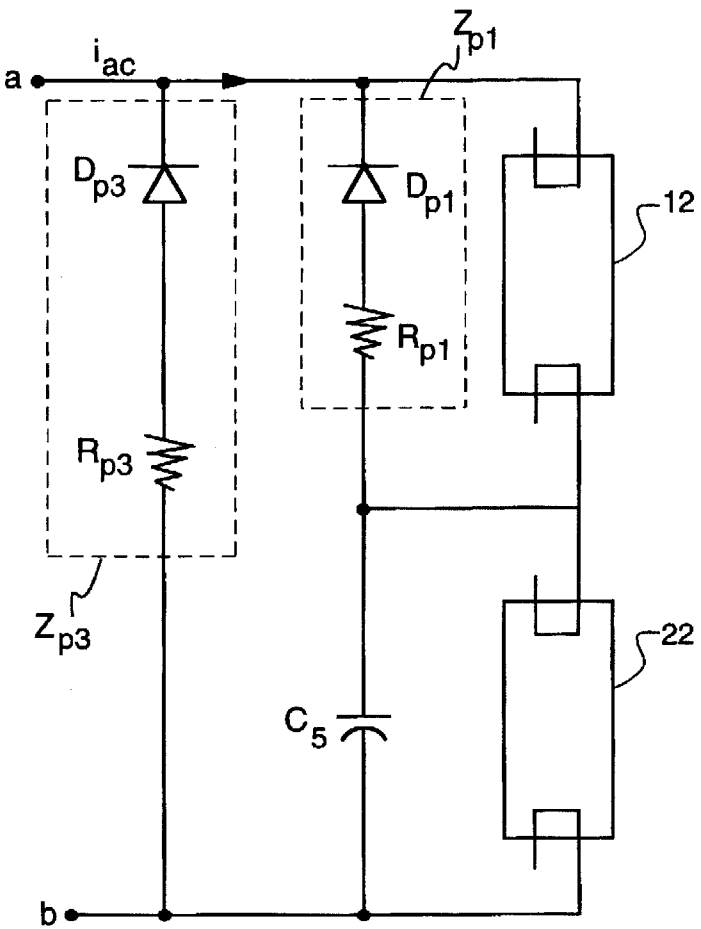
FIG. 7 schematically illustrates a dimmable fluorescent lamp system according to another alternative embodiment of the present invention.

FIG. 7 illustrates another alternative embodiment of a multiple lamp system wherein a parallel impedance $Z_{P3}$ is connected across the series combination of both lamps. In this embodiment, as shown, there is an additional parallel impedance $Z_{P1}$ coupled across one of the lamps. As in the other embodiments described hereinabove, the diodes may be oriented to conduct current in the same direction (i.e., either one) or opposite directions.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

What is claimed is:

1. A ballast system for at least one dimmable fluorescent lamp, comprising:

a ballast inverter for driving said at least one dimmable fluorescent lamp to provide light output; and a parallel impedance for coupling across said at least one fluorescent lamp for providing an alternative path to divert sufficient ac current to avoid developing striated light output.

2. The ballast system of claim 1 wherein said parallel impedance comprises a resistor connected in series with a diode.

3. The ballast system of claim 1 wherein said parallel impedance comprises an inductor connected in series with a diode.

4. The ballast system of claim 1 wherein said ballast inverter comprises a resonant switching inverter.

5. The ballast system of claim 1 for driving at least two dimmable fluorescent lamps, said parallel impedance being coupled across one of said lamps.

6. The ballast system of claim 1 for driving at least two dimmable fluorescent lamps, said parallel impedance being coupled across each of said lamps.

7. The ballast system of claim 6 wherein each said parallel impedance comprises a diode connected in series with a resistor.

8. The ballast system of claim 7 wherein said diodes of said parallel impedances are oriented to conduct current in the same direction.

9. The ballast system of claim 8 wherein said diodes of said parallel impedances are oriented to conduct current in opposite directions.

10. The ballast system of claim 1 for driving at least two dimmable fluorescent lamps, said parallel impedance being coupled across the combination of both lamps.

11. The ballast system of claim 10 wherein an additional parallel impedance is coupled across one of said lamps.

* * * * *